US012104597B2

(12) United States Patent
Desiron et al.

(10) Patent No.: US 12,104,597 B2
(45) Date of Patent: Oct. 1, 2024

(54) VACUUM PUMP LUBRICANT RECOVERY SYSTEM RETURNING LUBRICANT FROM THE AIR FILTER BASED ON PRESSURE MEASUREMENTS IN THE VACUUM PUMP

(71) Applicant: Atlas Copco Airpower N.V., Antwerp (BE)

(72) Inventors: Andries Desiron, Sussex (GB); Glenn Vinck, Antwerp (BE)

(73) Assignee: ATLAS COPCO AIRPOWER N.V., Antwerp (BE)

( * ) Notice: Subject to any disclaimer, the term of this patent is extended or adjusted under 35 U.S.C. 154(b) by 0 days.

(21) Appl. No.: 17/906,001

(22) PCT Filed: Mar. 10, 2021

(86) PCT No.: PCT/EP2021/056068
§ 371 (c)(1),
(2) Date: Sep. 9, 2022

(87) PCT Pub. No.: WO2021/180797
PCT Pub. Date: Sep. 16, 2021

(65) Prior Publication Data

US 2023/0122823 A1 Apr. 20, 2023

(30) Foreign Application Priority Data

Mar. 10, 2020 (BE) ..... 2020/5168

(51) Int. Cl.
*F04C 25/02* (2006.01)
*F04C 27/02* (2006.01)
*F04C 29/02* (2006.01)

(52) U.S. Cl.
CPC ..... *F04C 25/02* (2013.01); *F04C 27/02* (2013.01); *F04C 29/02* (2013.01); *F04C 29/021* (2013.01); *F04C 29/026* (2013.01)

(58) Field of Classification Search
CPC ..... F04C 25/02; F04C 27/02; F04C 29/02; F04C 29/021; F04C 29/026
See application file for complete search history.

(56) References Cited

U.S. PATENT DOCUMENTS 2,977,039 A 3/1961 Green et al.
3,778,192 A * 12/1973 Caffrey ..... F04C 29/02 417/295

(Continued)

FOREIGN PATENT DOCUMENTS

CN 101433728 A 5/2009
CN 103195713 A 7/2013

(Continued)

OTHER PUBLICATIONS

PCT Notification of Transmittal of the International Search Report and the Written Opinion of the International Searching Authority, or the Declaration and PCT International Search Report dated Jun. 7, 2021 for corresponding PCT application Serial No. PCT/EP2021/056068, 6 pages.

(Continued)

*Primary Examiner* — Mary Davis
(74) *Attorney, Agent, or Firm* — Theodore M. Magee; Westman, Champlin & Koehler, P.A.

(57) ABSTRACT

A lubricant recovery system for vacuum pump comprising a reservoir to store lubricant. Supply lines connected to the reservoir wherein the supply line can be connected to the vacuum pump to supply the lubricant to the vacuum pump. Further, a return line is connected to the reservoir to return a lubricant-air mixture from the vacuum pump to the reservoir by the return line. An air filter is disposed inside the reservoir to separate lubricant from the air wherein the filter is connected to a scavenge line which is connectable to a low-pressure region of the vacuum pump such that lubricant separated from the lubricant-air mixture by the air filter is (Continued)

drawn via the scavenge line into the vacuum pump. In accordance to the present invention a valve is disposed in the scavenge line to selectively separate the air filter from the vacuum pump.

13 Claims, 3 Drawing Sheets

(56) References Cited

U.S. PATENT DOCUMENTS

| | | | | |
|---|---|---|---|---|
| 3,961,862 | A | 6/1976 | Edstrom et al. | |
| 4,995,797 | A | 2/1991 | Tsuboi | |
| 4,997,597 | A | 3/1991 | Clough et al. | |
| 6,010,320 | A * | 1/2000 | Kwon | F04C 29/026 184/6.16 |
| 2016/0327045 | A1 | 11/2016 | Coeckelbergs et al. | |

FOREIGN PATENT DOCUMENTS

| | | | |
|---|---|---|---|
| CN | 104373348 | A | 2/2015 |
| CN | 207777189 | | 8/2018 |
| EP | 3508729 | A1 | 7/2019 |
| GB | 747344 | | 4/1956 |
| WO | 2017096438 | A1 | 6/2017 |

OTHER PUBLICATIONS

British Examination Report dated Dec. 1, 2020 and Search Report dated Nov. 30, 2020 for corresponding British application Serial No. GB2009627.7, 4 pages.

PCT Written Opinion dated Jun. 7, 2021 for corresponding PCT application Serial No. PCT/EP2021/056068, 7 pages.

Chinese Search Report dated Apr. 10, 24 for corresponding Chinese application Serial No. CN202180034371X, 2 pages.

* cited by examiner

VACUUM PUMP LUBRICANT RECOVERY SYSTEM RETURNING LUBRICANT FROM THE AIR FILTER BASED ON PRESSURE MEASUREMENTS IN THE VACUUM PUMP

CROSS-REFERENCE TO RELATED APPLICATION

This application is a Section 371 National Stage Application of International Application No. PCT/EP2021/056068, filed Mar. 10, 2021, and published as WO 2021/180797 A1 on Sep. 16, 2021, the content of which is hereby incorporated by reference in its entirety and which claims priority of Belgian Application No. BE2020/5168, filed Mar. 10, 2020.

FIELD

The present invention relates to a lubricant recovery system for vacuum pump and in particular for an oil-sealed vacuum pump. Further the present invention relates to a vacuum system with such a lubricant recovery system.

BACKGROUND

Vacuum pumps and in particular oil-sealed vacuum pumps in accordance to the state of the art are connected to an oil or lubricant supply line supplying oil to the vacuum pump from a reservoir. During the pumping process the lubricant or oil is mixed with air any other gaseous medium which is conveyed by the vacuum pump. The air-lubricant mixture is then returned to the reservoir by a return line connected to the vacuum pump. In the reservoir the oil is collected at the bottom of the reservoir wherein the supply line is fed from the bottom of the reservoir. However, a certain amount of oil remains in the air above the oil level in the reservoir. This oil- or lubricant-air mixture is drawn through an air filter where the lubricant is separated from the air. The lubricant collected by the air filter is drawn into the vacuum pump through the scavenge line due to the pressure difference between the low pressure or vacuum in the low-pressure region of the vacuum pump, thereby being recovered into the lubricant cycle of the vacuum system.

Thus, scavenging of the oil or lubricant from the oil/lubricant-air mixture is carried out by the pressure difference between the reservoir and the pump wherein usually the reservoir tank is at atmosphere pressure or even higher and the low-pressure region of the vacuum pump is below atmospheric pressure, i.e. vacuum.

The discussion above is merely provided for general background information and is not intended to be used as an aid in determining the scope of the claimed subject matter. The claimed subject matter is not limited to implementations that solve any or all disadvantages noted in the background.

SUMMARY

In the following the term lubricant is used for any kind of lubricant or oil necessary or used for operation of the vacuum pump.

Under certain working conditions of the vacuum pump relating in particular to different rotation of speeds in case of a variable speed drive (VSD) the lubricant carryover for the scavenge line is not constant since under some working conditions of the vacuum pump less air is mixed into the lubricant, i.e. a less amount of lubricant can be separated by the air filter. This results in the fact that there is not enough lubricant to fill the scavenge line completely and as a result air will enter the scavenge line. Through the scavenge line this air enters the vacuum pump and reduces the pumping speed and pump performance such that the ultimate pressure of the vacuum pump is increased. Therein, the lubricant carryover is the amount of lubricant that is carried by the air and that is separated by the air filter and available for scavenging back to the vacuum pump.

It is an object of the present invention to provide a lubricant recovery system which is able to maintain the performance of the vacuum pump.

The lubricant recovery system for a vacuum pump in accordance to the present invention comprises a reservoir to store a lubricant. A supply line is connected to the reservoir wherein the supply line can be connected to the vacuum pump to supply the lubricant to the vacuum pump for operation. Further, a return line is connected to the reservoir to return a lubricant-air mixture from the vacuum pump to the reservoir. Lubricant returned by the return line is usually collected at the bottom of the reservoir. However, above the lubricant level a lubricant-air mixture evolves. In accordance to the present invention an air filter is disposed inside the reservoir to separate the lubricant from the air wherein the filter is connected to a scavenge line. The scavenge line is connected to a low pressure region of the vacuum such that lubricant separated from the lubricant-air mixture by the filter is drawn through the scavenge line into the vacuum pump due to the pressure difference between the pressure inside the reservoir which is usually at atmospheric pressure and the low pressure region of the vacuum pump, which is at lower pressure, i.e. vacuum. Further, a valve is disposed in the scavenge line selectively separate the filter from the vacuum pump. Thus, air from the reservoir can be prevented to enter the vacuum pump and reduce the pump performance of the vacuum pump.

In particular, the valve is closed in working conditions of the vacuum pump in which less lubricant carryover occurs. This usually relates to low pressure, high vacuum conditions. Contrary, the valve is open if there is a considerable amount of lubricant carryover. Therein, the lubricant carryover is the amount of lubricant that is carried by the air in the reservoir and that is separated by the air filter.

In particular, the valve is connected to a control unit. Further, a pressure gauge is arranged at the low-pressure region of the vacuum pump or inside a vacuum apparatus connected to the vacuum pump in order to measure the pressure inside. Preferably, the low-pressure region of the vacuum pump might refer to the inlet of the vacuum pump. The control unit is configured to control the valve in dependence on the measured pressure. Preferably, if the vacuum pump operates at high pressure close to atmosphere, for example during startup, the valve is controlled to be open since there is sufficient lubricant carryover in the scavenge line to completely fill the scavenge line. If the vacuum pump operates at low-pressure or high vacuum, then the lubricant carryover is reduced and there is no sufficient lubricant collected by the air filter to completely fill the scavenge line. Thus, in order to prevent air from the reservoir to enter into the vacuum pump the valve is controlled to be closed in dependence on the measured pressure.

In particular, the control unit is configured to close the valve if the measured pressure is below a threshold. Preferably, the threshold is predetermined and depends on the vacuum pump type or the configuration of the lubricant recovery system such as size of the scavenge line for example.

In particular, the valve is a throttle valve and the control unit is configured to reduce the flow through the throttle valve in dependence on the measured pressure. Thus, by reducing the flow through the throttle valve, it is avoided that an insufficient amount of lubricant is collected by the air filter to completely fill the scavenge line. Thus, by reducing the flow through the scavenge line by the throttle valve it is prevented that air enters the vacuum pump which would reduce the pump performance of the vacuum pump. Preferably, by the throttle valve the reduction of the flow can be controlled continuously in dependence on the measured pressure.

In particular, a bypass line is employed in the scavenge line bypassing the valve such that a low-pressure provided by the vacuum pump is maintained at the air filter even if the valve is closed. Thus, even if the vacuum pump is operated under such conditions in which the valve is closed the functionality of the air filter is maintained by maintaining the low-pressure at the air filter via the bypass line such that lubricant is drawn from the air filter into the vacuum pump. Thus, even if the valve is closed the remaining amount of oil carryover is effectively filtered by the air filter in the lubricant recovery system and scavenged to the vacuum pump.

In particular, the bypass line has a diameter smaller than the diameter of the scavenge line to provide a reduced flow through the bypass line compared to the flow through the scavenge line. Additionally, or alternatively an orifice is disposed in the bypass line wherein the orifice has a diameter smaller than the diameter of the scavenge line to reduce the flow accordingly. Thus, either the diameter itself of the bypass line or the orifice or both in combination works as a throttle to reduce the flow through the scavenge line from the air filter to the vacuum pump even under conditions when there is less lubricant carryover in order to make sure that the scavenge line is completely filled with lubricant.

In particular, the throttle valve is disposed in the bypass in order to continuously control the throttle effect provided in the bypass line preferably by the control unit, in dependence on the measured pressure.

In particular, two or more air filters are disposed in the reservoir wherein each filter is connected with a scavenge line.

In particular, at least two and preferably all scavenge lines are fed together to a common scavenge line wherein the valve is disposed in the common scavenge line connected to the vacuum pump. However, it is also possible that each scavenge line has its own valve and connected to different positions of the low-pressure region of the vacuum pump.

In particular, each scavenge line is connected by a bypass line to bypass any valve in each of the scavenge lines. Thus, even if there are two or more air filters operation of the air filters can be maintained even if the valve of each scavenge lines are closed.

In particular, the scavenge line is connectable to a first stage of the vacuum pump while the bypass line is connectable to a second stage of the vacuum pump wherein in the first stage a lower pressure is present than in the second stage of the vacuum pump under operation. Since in the second stage lower pressure is present, the pressure difference between the reservoir and the second stage is reduced. Thus, flow through the scavenge line is reduced if the valve is closed due to the reduced pressure difference and as a consequence even under conditions when there is less lubricant carryover there is enough lubricant to fill the scavenge line completely to prevent air to enter into the vacuum pump and reduce the pump efficiency of the vacuum pump.

Further, the present invention relates to a vacuum system comprising a vacuum pump and a lubricant recovery system as previously described.

In particular, the vacuum pump has a housing comprising an inlet and an outlet and at least one pump element disposed in the housing and rotated by a motor in order to convey a gaseous medium from the inlet to the outlet of the vacuum pump. Further, the housing comprises a lubricant supply connection connected to a lubricant supply line of the lubricant recovery system. Further, the housing comprises a lubricant return connection connected to the return line of the lubricant recovery system in order to return the lubricant air mixture to the reservoir.

In particular, the vacuum pump is an oil-sealed vacuum pump and in particular a screw pump, scroll pump, claw pump or a rotary-vane pump.

In particular, the vacuum pump has a first stage and a stage wherein when in operation the pressure in the first stage is below the pressure in the second stage.

In particular, the scavenge line and preferably all scavenge lines are connected to the first stage while the bypass line and preferably all bypass lines are connected to the second stage in order reduce the pressure difference between the vacuum pump and the reservoir.

The summary is provided to introduce a selection of concepts in a simplified form that are further described in the detailed description. This summary is not intended to identify key features or essential features of the claimed subject matter, nor is it intended to be used as an aid in determining the scope of the claimed subject matter.

BRIEF DESCRIPTION OF THE DRAWINGS

The present invention is further describing in accordance to the accompanied drawings.

It is shown.

DETAILED DESCRIPTION

Figure 1:
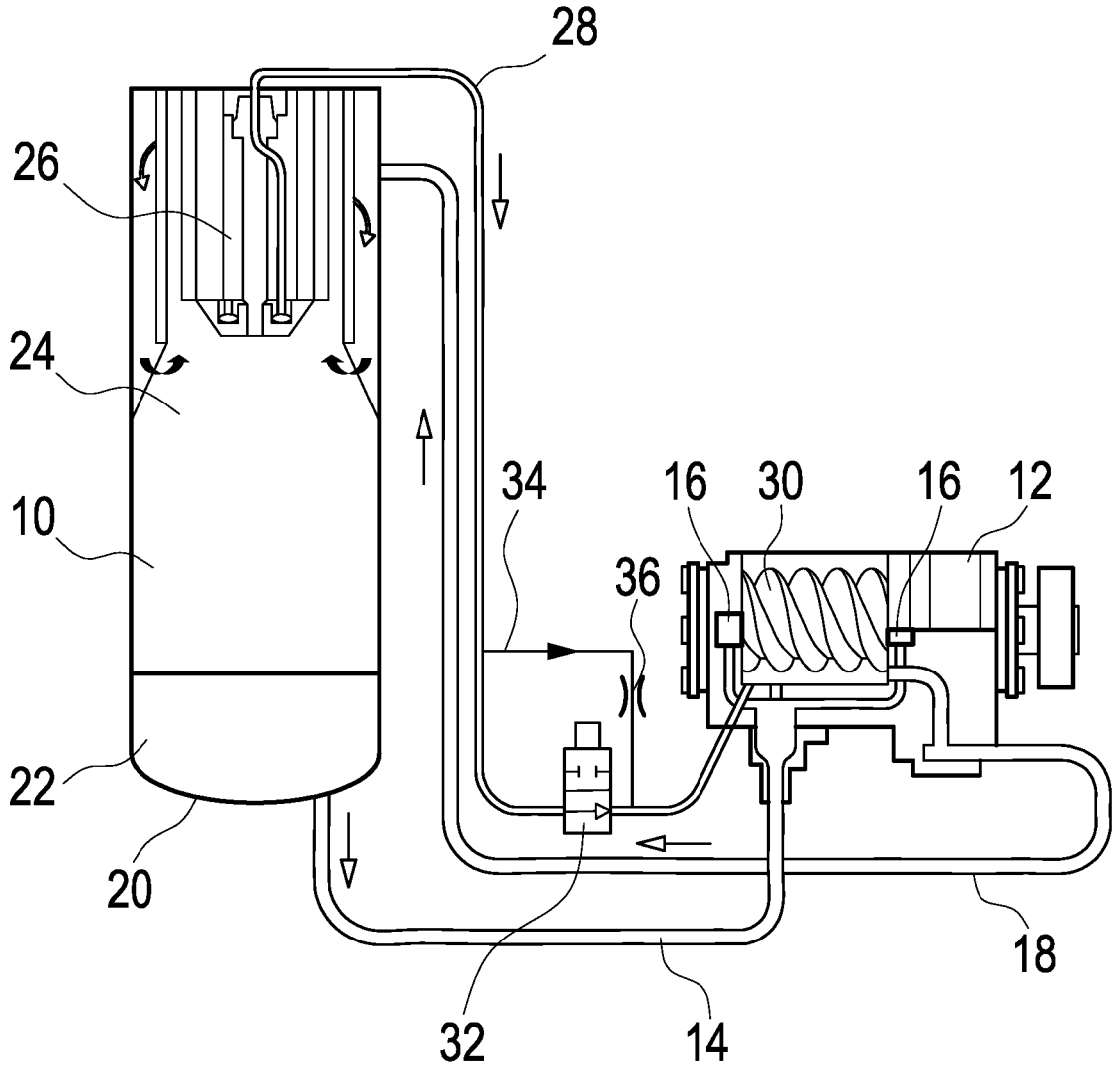
FIG. 1 shows first embodiment of the present invention

In the first embodiment a reservoir 10 is connected to a vacuum pump 12 by a supply line 14 supplying a lubricant to the vacuum pump 12 and in particular to the bearings 16 of the vacuum pump 12. During the pump process the lubricant is mixed with air or any other gaseous medium conveyed by the vacuum pump 12. This lubricant-air mixture is returned by a return line 18 to the reservoir 10. The lubricant is then collected at the bottom 20 of the reservoir 10. Above the lubricant level 22 an oil-air mixture 24 is still present. Further, inside the reservoir 10 an air filter 26 is disposed wherein the lubricant-air mixture is drawn through the air filter 26 and the lubricant is separated from the air. The lubricant-air mixture is filtered by the air filter 26 by a pressure difference between the vacuum pump 12 usually operating at pressures below atmosphere, i.e. vacuum, and the pressure inside the reservoir 10, usually atmospheric pressure or even above. Thus, a scavenge line 28 is provided between the filter 26 and a low-pressure region 30 of the vacuum pump 12. Thus, lubricant separated by the air filter 26 is returned by the scavenge line 28 to the vacuum pump 12 and then recycled into the normal cycle of the lubricant.

However, there are operating situations of the vacuum pump where there is less lubricant carryover, i.e. only a little amount of lubricant is present above the lubricant level 22 in the reservoir 10. Thus, if further operated there is not enough lubricant anymore to completely fill the scavenge line 28. As a consequence, air from the reservoir 10 might enter the low-pressure region 30 of the vacuum pump 12 counteracting the generation of the vacuum pump 12 and thereby reducing the pump performance or the lowest achievable pressure of the vacuum pump 12. In order to avoid these circumstances, a valve 32 is disposed in the scavenge line 28 in order to separate the air filter 26 from the low-pressure region 30 of the vacuum pump 12. As a consequence, no air can enter into the low-pressure region 30 of the vacuum pump 12 anymore if the valve 32 is closed increasing or at least maintaining the pump performance of the vacuum pump 12. However, if the valve 32 is closed no lubricant is scavenged from the lubricant-air mixture in the reservoir 10 by the air filter 26 anymore since the vacuum of the low-pressure region 30 is not provided to the air filter 26 anymore. Thus, a bypass line 34 is used bypassing the valve 32. In the bypass line 34 an orifice 36 is present in order to reduce the flow through the scavenge line 28. Hence, in the case of a closed valve 32 and due to the reduced flow through the scavenge line 28, no air from the reservoir 10 can enter into the low-pressure region 30 of the vacuum pump 12. Thus, the performance of the vacuum pump 12 is maintained efficiently.

Figure 2:
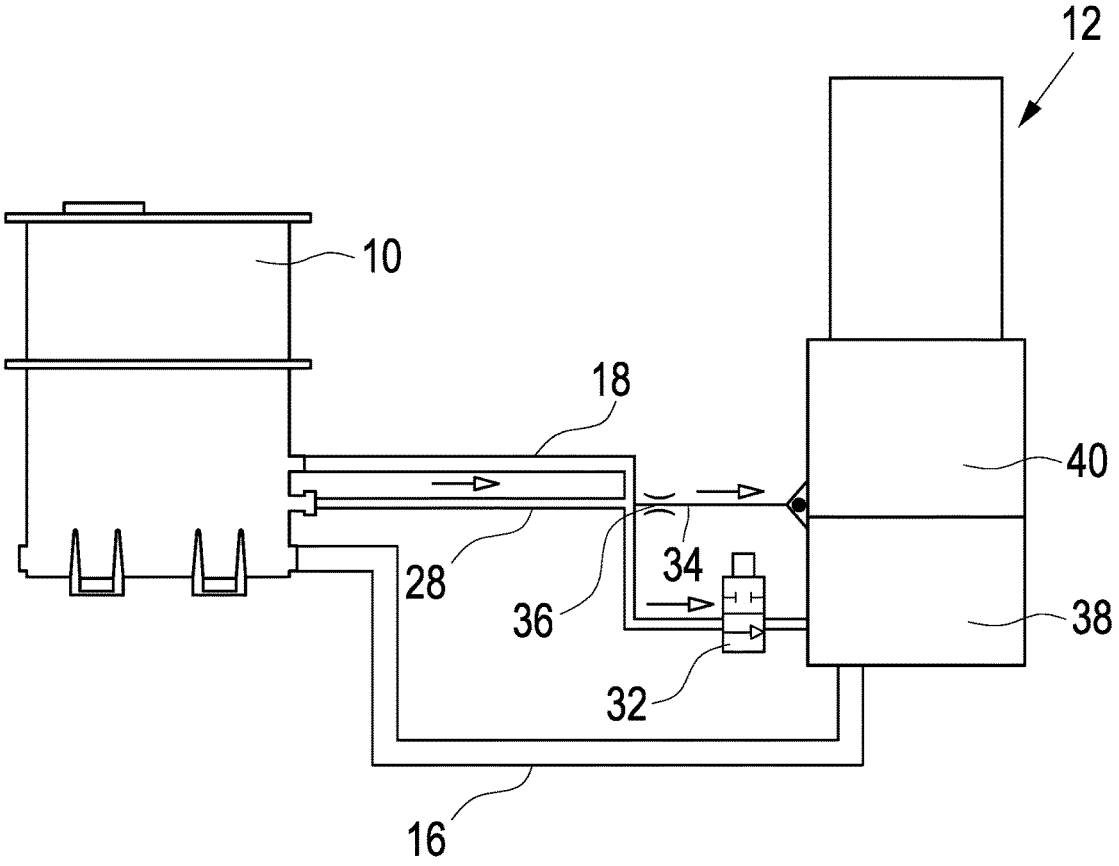
FIG. 2 shows a second embodiment of the present invention.

In the second embodiment shown in FIG. 2 same or similar elements are indicated with identical reference signs. However, in the following only the differences between the first embodiment and the second embodiment are described.

In the second embodiment the vacuum pump 12 comprises a first stage 38 and a second stage 40 wherein the pressure in the first stage 38 is below the pressure of the second stage 40. The scavenge line 28 is connected to the first stage 38 of the vacuum pump 12. The bypass line 34 is bypassing the valve 32 and connected with the second stage 40 of the vacuum pump 12. Thus, under conditions when the valve 32 is closed no air can be drawn into the first stage 38 of the vacuum pump 12 anymore. However, since the bypass line 34 is connected to the second stage 40 of the vacuum pump 12, a reduced pressure difference between the second stage 40 of the vacuum pump 12 and the reservoir 10 is present compared to the situation of an open valve 32 connecting the air filter 26 to the first stage 38 of the vacuum pump 12. Due to the reduced pressure difference the flow through the scavenge line 28 is reduced accordingly in order to make sure that there is always sufficient lubricant to completely fill the scavenge line 28 and thereby prevent air to enter into the vacuum pump 12. In addition, an orifice 36 or throttle is employed in the bypass line 34 to further reduce the flow through the bypass line 34.

Figure 3:
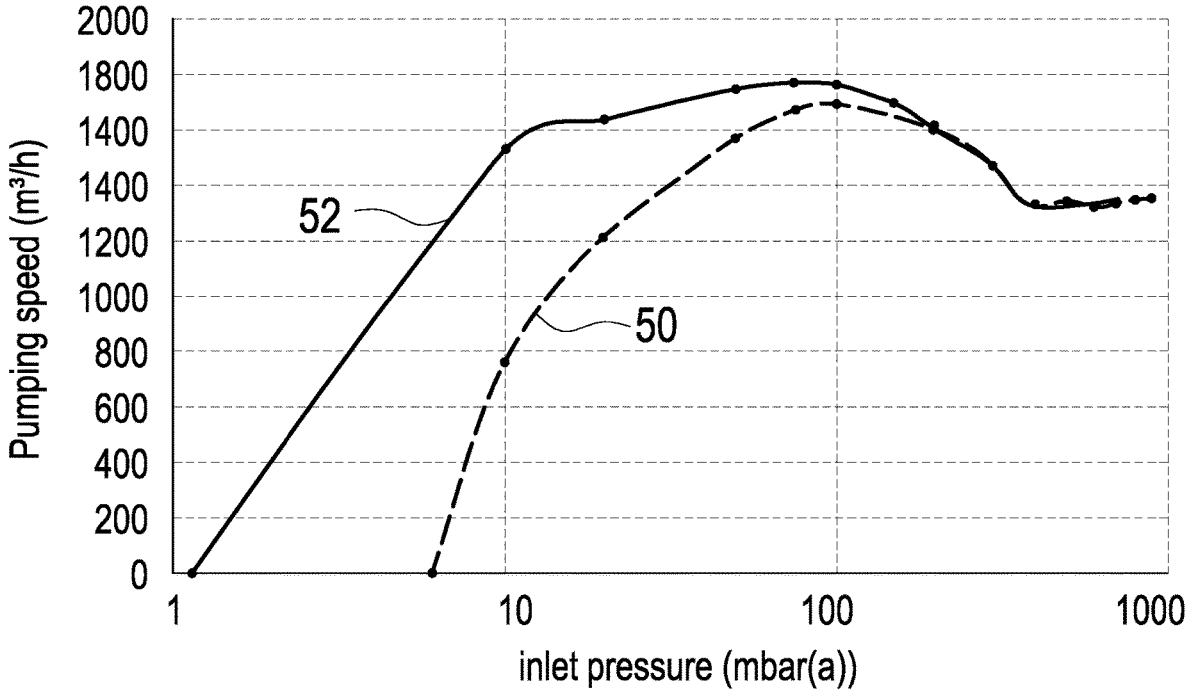
FIG. 3 shows a comparison between a vacuum pump of the prior art and a vacuum pump accordance with the present invention.

FIG. 3 shows a comparison between a vacuum system according to the prior art by line 50 compared to the vacuum system of the first embodiment by line 52. At the y-axis of the graph the pumping speed in $m^3/h$ is shown over the inlet pressure in mbar. In the prior art for low-pressures the lubricant carryover is reduced. Thus, the scavenge line in the prior art vacuum systems cannot be completely filled anymore. Air from the reservoir enters into the vacuum pump resulting I a shifted ultimate pressure of the vacuum pump. In the embodiment of the present invention the flow is reduced in the scavenge line such that there is under every operational condition sufficient lubricant to completely fill the scavenge line. As a consequence and in accordance with the present invention, no air can enter into the vacuum pump 12. Thus, the ultimate pressure of the vacuum pump is lower compared to the prior art while the pumping speed is always above that of the prior art.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A lubricant recovery system for a vacuum pump comprising:

a reservoir to store a lubricant;

a supply line connected to the reservoir, wherein the supply line can be connected to the vacuum pump to supply the lubricant to the vacuum pump;

a return line connected to the reservoir to return a lubricant-air mixture from the vacuum pump to the reservoir by the return line;

an air filter disposed inside the reservoir to separate lubricant from the lubricant-air mixture, wherein the air filter is connected to a scavenge line, wherein the scavenge line is connectable to a low-pressure region of the vacuum pump such that lubricant separated from the lubricant-air mixture by the air filter is drawn via the scavenge line into the vacuum pump;

a valve is disposed in the scavenge line to selectively separate the air filter from the vacuum pump, wherein the valve is connected to a control unit; and a pressure gauge arranged at the low-pressure region of the vacuum pump or inside a vacuum apparatus connected to the vacuum pump in order to measure the pressure inside, wherein the control unit is configured to control the valve in dependence on the measured pressure.

2. The lubricant recovery system according to claim 1, characterized in that the control unit is configured to close the valve if the measured pressure is below a threshold.

3. The lubricant recovery system according to claim 1, characterized in that the valve is a throttle valve and the control unit is configured to reduce the flow through the throttle valve upon decreasing measured pressure.

4. The lubricant recovery system according to claim 1, characterized by a bypass line bypassing the valve in the scavenge line such that low-pressure at the air filter is maintained even with a closed valve.

5. The lubricant recovery system according to claim 4, characterized in that the bypass line has a diameter smaller than the diameter of the scavenge line and/or an orifice is disposed in the bypass line, wherein the orifice has a diameter smaller than the diameter of the scavenge line.

6. The lubricant recovery system according to claim 4, characterized in that a throttle valve is disposed in the bypass line.

7. The lubricant recovery system according to claim 1, characterized in that two or more air filters are disposed in the reservoir, wherein each of the two or more air filters is connected with a scavenge line.

8. The lubricant recovery system according to claim 7, characterized at least the scavenge line comprises at least two scavenge lines that are each respectively connected to the respective two or more air filters, wherein the at least two scavenge lines are joined together to make a common scavenge line containing the valve and connect to the low-pressure region of the vacuum pump.

9. The lubricant recovery system of claim 7, characterized in that the scavenge lines comprises at least two scavenge lines each having a respective valve where each one of the at least two scavenge lines are connected by a respective bypass line to bypass the respective valve in each of the at least two scavenge lines.

10. A vacuum system comprising the vacuum pump and the lubricant recovery system according to claim 1.

11. The vacuum system according to claim 10, characterized in that the vacuum pump is an oil-sealed vacuum pump comprising one of a screw pump, scroll pump, claw pump, rotary-vane pump.

12. The vacuum system according to claim 10, characterized in that the vacuum pump has a first stage and a second stage, wherein in operation the pressure in the first stage is below the pressure in the second stage.

13. The vacuum system according to claim 12, characterized in that the scavenge line is connected to the first stage and a bypass line bypassing the valve in the scavenge line is connected to the second stage.

* * * * *